United States Patent [19]

Smith

[11] 4,008,803

[45] Feb. 22, 1977

[54] PACKAGE FOR TWO REACTIVE INGREDIENTS OF A DESIRED MIX IN A SINGLE PACK

[76] Inventor: F. Charles Smith, 9 Glenview Road, Strathmore, Victoria, Australia, 3041

[22] Filed: Nov. 7, 1973

[21] Appl. No.: 413,578

[30] Foreign Application Priority Data

Nov. 8, 1972 Australia ..... 1150/72

[52] U.S. Cl. ..... 206/220

[51] Int. Cl.[2] ..... B65D 25/08

[58] Field of Search ..... 206/219, 220, 1.8

[56] References Cited

UNITED STATES PATENTS

| | | | |
|---|---|---|---|
| 3,618,751 | 11/1971 | Rich | 206/219 |
| 3,756,386 | 9/1973 | Marckardt | 206/219 |
| 3,713,779 | 1/1973 | Sirago et al. | 206/219X |

*Primary Examiner*—Leonard Summer

[57] ABSTRACT

A package in the form of a complete kit for two reactive ingredients such as a resin and a hardener in one single pack each within a separate sealed flexible sac and this same pack is so formed as to provide a mixing bowl and also to hold a separate mixing spatula for detachment and cutting of formed projections on sacs which are then to be squeezed and emptied into preformed bowl for mixing and spreading of the mix on work with the same spatula and the materials and method of manufacture of this pack are such as to permit the folding of the pack on itself over the bowl and spatula for clean disposal after its single and only use.

1 Claim, 4 Drawing Figures

PACKAGE FOR TWO REACTIVE INGREDIENTS OF A DESIRED MIX IN A SINGLE PACK

PRIOR ART

Bonding mixtures have been made from bulk packs of each of hardener and resin by selectively measuring out ingredients to a mixing bowl and mixing with a selected tool or in another case the ingredients have been dispensed in unit-related packs one of which is the hardener in a metallic tube for injection into a part filled plastic bottle containing resin for squeeze mixing prior to extrusion from plastic bottle to desired application.

With the bulk packs there are disadvantages insofar that the ratio of mix from bulk stocks may be a source of error and the use of a separate mixing bowl and tool may be a source of contamination and resealing of the bulk container is unavoidably accompanied by stickyness and in the case where the ingredients are dispensed in unit-related packs for injection of hardener into part filled plastic bottle there is a wellfounded fear of squeeze mixing due to bursting of the plastic bottle because of bulk resistance when the viscosity increases with climatic change or an over excessive application of pressure.

There is convenience in detaching a new clean spatula from the proposed pack and emptying the correctly ratioed quantities of ingredients for mix in a clean new bowl all contained in the one pallette or pack for application to work with the same tool and when complete for clean disposal of excess material and spatula within the readily folded pack.

SUMMARY OF INVENTION

With this invention the objective is to combine all requisite items within one pack for complete use and ready disposal and to achieve this a sandwich pack is made from two formed halves of multi-layer material encasing two or more adjacent but separate sacks of hardener and resin and with formed mating bowl shapes in each half and with a detachable spatula only partly sealed in between the two sandwich halves forming the pack and with a projection formed on each of the sacs to lead to the formed bowl and these projections are for opening with the spatula prior to squeezing the contents into the bowl for mixing and application until sufficient is used when the spatula and bowl with excess mix are folded within the flexible pack for clean disposal.

BRIEF DESCRIPTION OF VIEWS OF DRAWINGS

DETAILED DESCRIPTION

The construction shown in FIGS. 1–4 of a single pack or kit containing two reactive ingredients viz. resin 10 and hardener 11 in a well separated and sealed condition, together with an appropriately sized and positioned mixing bow 12 and a detachably positioned spatula 13 all suited to mixing and application completely to the work without any other extraneous item.

Figure 1:
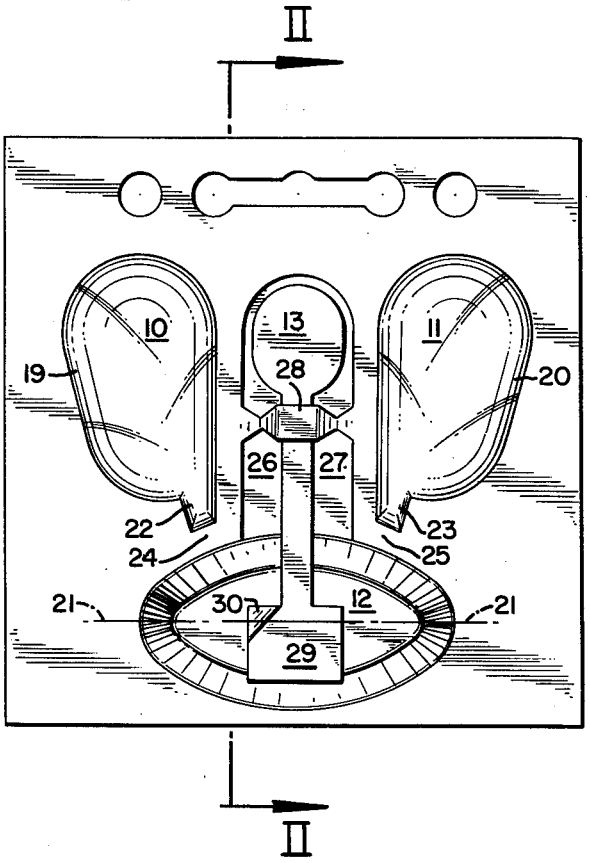
FIG. 1 shows a layout plan of pack in accordance with the invention
Figure 2:
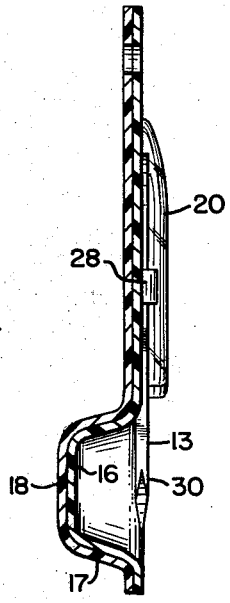
FIG. 2 shows the side section through pack at line II II in FIG. 1
Figure 3:
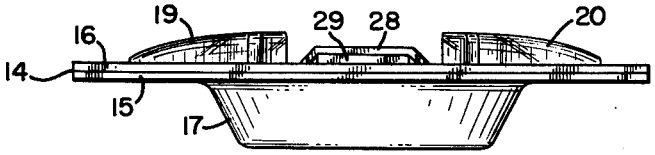
FIG. 3 shows the end elevation of pack
Figure 4:
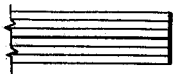
FIG. 4 shows the enlarged detail of the construction of two sheets of multi-layered material of thermo plastic and metallic membrance

The pack or kit is made of a top half 16 and a bottom half 15, these are two strips of the same multi-layered thermo-plastic laminated material as shown in enlarged view FIG. 4 each of which has been separately preformed as shown in FIG. 2. The top half 16 has the sacs 19 and 20 formed to encase the separated ingredients of resin 10 and hardener 11 and has areas 26 and 27 deleted allowing a narrow strip 28 to remain between the areas 26 and 27 which are parts of the same larger area partly filled in by the spatula 13. Also both the top half 16 and bottom half 15 have a similar matching shape of bowl 12 preformed to mate together when sealed and so form an open mixing bowl integrated with the pack. When the top half 16 is temporarily inverted and the contents 10 and 11 of the sacs 19 and 20 are put into position and also with the spatula 13 positioned over the narrow strip 28 the bottom half 15 may be securely thermo-sealed to the top half 16 at inner faces 14 to sandwich contents 10 and 11 within sacs 19 and 20 and to completely seal the total area but not including sacs 19 and 20 and areas 26 and 27 or area of strip 28. The strip 28 holds the spatula 13 firmly through a slight stretching of the strip 28 but the spatula 13 may be detached by lifting end 29 of spatula 13 which is accessible for purchase by fingers and by breaking the strip 28 and then by application of the suitably shaped sharp point 30 of the spatula 13 so cutting and rupturing projections 22 and 23 on each of the separate sacs. When projections 22 and 23 are ruptured both sacs 10 and 11 are squeezed and the contents extruded across narrow sealed margins 24 and 25 into bowl 12 for mixing with spatula end 29. The laminated strips for top half 16 and bottom half 15 are each preferably constructed of three films of which the middle one is to be a non-translucent metallic membrance or alternatively a metalized inner face on one of the other two sheets. The outer sheet is to be a tough printable plastic film and the inner sheet is to be a readily thermosealed type of plastic film but to be resistant to chemical reaction with the contents. These laminated strip materials are identical for top half 16 and bottom half 15 and are to be flexible yet when the double thicknesses are therm-sealed together at each of the inner faces 14 they become rigid enough to offer a pallette effect and this is further assisted by the depth shaping of the bowl 17 and also by applying a rigidizing dimpled pattern to surface 18 on top side of bottom half 15. Also, when the spatula 13 has been detached and the contents of 10 and 11 of the sacs 19 and 20 have been emptied into bowl 12 the rigidity is reduced in the plane of the pack around or along the centre line of the pack parallel to the long axis 21 to 21 of the oval bowl 12. At this line 60% of the width of the top half 16 is not sealed to bottom 15 and this allows the pack to be foldable in half over the bowl 12. When sufficient mixing has been done in bowl 12 and the required quantity of mix applied to the work with the spatula 13 then the spatula 13 may be laid over the long axis of the bowl 12 and the pack folded over the spatula 13 and bowl 12 which contains any surplus mix which is thereby neatly sealed for disposal without stickiness.

I claim:

1. A package comprising two strips of thermo-plastic material sealed in face-to-face relation, one of said strips having two cut-out apertures in its central portion separated by a band integral with the material of said strip and a preformed cavity projecting downwardly from the plane of the strip adjacent one of the apertures, said strip also having a preformed sac projecting upwardly from the plane of the strip on each side of said central portion, a quantity of resin in one of said sacs and a quantity of hardener in the other of said sacs, said second strip having a preformed cavity projecting downwardly and mating with said first cavity to form a mixing bowl, each said sac having a projection adjacent said mixing bowl, a flat spatula extending along said cut-out apertures, said spatula underlying said band and overlying said bowl and having a sharpened point for rupturing said projections to permit extrusion of the contents of said sacs into said mixing bowl.

* * * * *